United States Patent [19]

Detalle et al.

[11] Patent Number: 4,688,704

[45] Date of Patent: Aug. 25, 1987

[54] METHOD FOR CONTROLLING AND OPENING CASTING HOLES IN RECEPTACLES FOR CONTAINING LIQUID METAL AND DEVICE FOR IMPLEMENTATION

[76] Inventors: Richard Detalle; Pol Detalle, both of 11, Rue Edouard Herriot, 54600 Villers-les-Nancy, France

[21] Appl. No.: 616,470

[22] PCT Filed: Sep. 28, 1983

[86] PCT No.: PCT/FR83/00191

§ 371 Date: May 23, 1984

§ 102(e) Date: May 23, 1984

[87] PCT Pub. No.: WO84/01315

PCT Pub. Date: Apr. 12, 1984

[30] Foreign Application Priority Data

Sep. 28, 1982 [FR] France ..... 82 16322

[51] Int. Cl.[4] ..... B22D 41/08

[52] U.S. Cl. ..... 222/590; 222/600; 266/271

[58] Field of Search ..... 222/590, 591, 597, 598, 222/600, 594, 595, 596, 603; 164/437; 266/271

[56] References Cited

U.S. PATENT DOCUMENTS

| | | | |
|---|---|---|---|
| 2,348,199 | 5/1944 | Freeman | 222/590 |
| 3,931,913 | 1/1976 | Meier | 222/600 |
| 4,325,495 | 4/1982 | Mokris | 222/195 |
| 4,450,986 | 5/1984 | Havasym et al. | 222/603 |

FOREIGN PATENT DOCUMENTS

| | | | |
|---|---|---|---|
| 80/01659 | 8/1980 | World Int. Prop. O. | 222/594 |
| 1581058 | 12/1980 | United Kingdom | 222/590 |

*Primary Examiner*—Joseph J. Rolla
*Assistant Examiner*—Frederick R. Handren
*Attorney, Agent, or Firm*—Beveridge, DeGrandi & Weilacher

[57] ABSTRACT

Method for controlling and opening casting holes in containers holding liquid metals, characterized by providing a pressure fluid supply conduit (6), which opens out at the base of a spout (3), a variable speed distributor (7) and a pressure tank (8) being arranged on the supply conduit, and by providing successive pulses to propel inside the container a solidified metal plug.

9 Claims, 2 Drawing Figures

METHOD FOR CONTROLLING AND OPENING CASTING HOLES IN RECEPTACLES FOR CONTAINING LIQUID METAL AND DEVICE FOR IMPLEMENTATION

BACKGROUND OF THE INVENTION

The present invention relates to the means for opening an orifice provided in a receptacle intended to contain a substance capable of sdlidifying, such as a metal melt, particularly steel or cast iron.

It applies to methods for closing and opening, by means of shutters, of the above- mentioned orifice, which may be intended either for introducing material into the metal melt through the wall of the container, or for emptying the container of all or a part of its contents.

In general, the wall of the container receives an internal spout and a fixed refractory plate pierced by facing orifices, and a movable external shutter.

In the use of such external shutters, it has been found that the metal sets very quickly in the region of the piercing in the fixed refractory plate and in the casting channel of the internal spout, that is to say, when metal has spent some time in the container, the metal does not flow when the shutter is opened. The setting of the molten metal results from an excessive heat loss to which it is subjected in contact with the refractory materials forming the inner spout of the fixed plate and the movable plate of the shutter and the imposed geometry of the casting channel in this region.

Hitherto, when the above- mentioned phenomenon appeared, the procedure was to blow oxygen into the casting channel to produce a sufficient heating of the region in question to re-form the casting jet, this blowing-in being generally carried out from outside the container, the shutter being wide open.

Attempts have been made to avoid this difficulty by preventing the access of the molten metal to the casting channel before the first opening of the shutter, particularly by the introduction of a product into the casting channel before filling the container with the liquid metal. The product can be in the form of a solid, deformable or fusible plug, a liquid composition such as, for example, lead or more generally in the form of a sand, for example zircon, silica, chromite, and graphite in pure or mixed form. A feature of these proposals is that the plugging product is always supposed to flow through the casting hole when the shutter is opened, which can moreover present some disadvantages.

It is found in practice that these processes do not make it possible to guarantee completely that metal will flow after the shutter is opened. Whatever the product employed, a solidified bridge is sometimes formed which is sufficiently strong to hold up the liquid metal. For this reason, the initial solution, consisting in blowing in oxygen through the casting channel, is being used again. In addition to the particular disadvantages of this process, it happens that, in some cases, the design of the casting device makes access to the casting hole difficult or even impossible. This is the case, in particular, when the spout is extended by a long tube intended fdr the protection of the metal jet, or when the casting is carried out under vacuum. A more recent invention, described particularly in the patent applied for in Switzerland on July 12, 1968 under No. 10,437/68, proposes to avoid or eliminate the above- mentioned setting of the molten metal in the casting channel by blowing in gas under pressure in the lower part of the said casting channel. The introduction of the gas is obtained particularly by means of a gas supply opening into at least one additional hole in the movable shutting plate of the shutter, the said hole being capable of being shut or not by a refractory substance permeable to the gases and impermeable to the metal, at least when the gas is allowed to pass through the said substance.

Such a process is found in practice to guarantee a satisfactory percentage of opening but nevertheless has some disadvantages.

Experience shows, in fact, that a permanent circulation of gas in the casting channel does not necessarily guarantee the total absence of solidifying of the metal.

The gas can in fact continue to pass through one or more channels within a plug of metal which is solidifying.

When the introduction of gas is stopped and the intention is to carry out the casting by sliding the movable plate into an appropriate position, the said channels block instantly and the plug of solidified steel becomes consistent enough to prevent the casting of the hot metal contained in the receptacle.

SUMMARY OF THE INVENTION

The present invention proposes to introduce a fluid (gas or liquid) into the casting channel in a non-continuous manner so as to permit the transient formation of the plug of solidifying steel followed by its discharge under the effect of the pressure of the fluid.

This irregular introduction of the fluid produces a series of shocks of variable amplitude and frequency under the effect of a suitable propelling device, and this shock effect results in the unblocking of the channel.

In fact, a continuous pressure produces streamlets of gas or liquid which penetrate between the solidification zones and do not produce any wrenching actions.

On the other hand, a series of shocks, variable in amplitude and frequency, produces momentary overpressures the effect of which is closely related to more or less sudden explosions which result in the wrenching away of the solidification zones.

In an alternative form of embodiment, the invention proposes to arrange inside the casting channel a rigid cylinder and movable plunger and to eject the latter inside the receptacle by the discharge of fluid under pressure.

The flow of the fluid (gas or liquid) inside the casting channel can take place through one or more holes or through a porous substance.

BRIEF DESCRIPTION OF THE DRAWINGS

The invention will now be described with reference by way of example to embodiments shown in the attached drawing, and in which.

DETAILED DESCRIPTION

Figure 1:
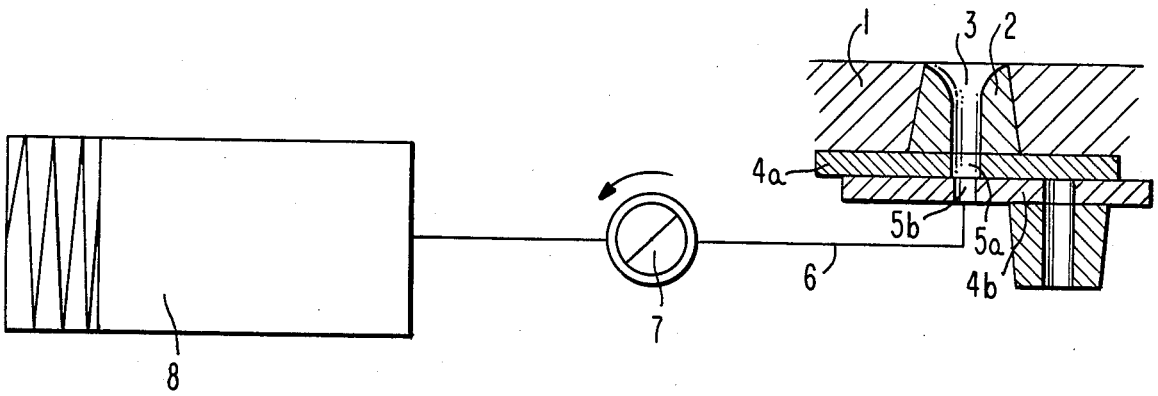
FIG. 1 is a diagram of a first embodiment.

With reference to FIG. 1, this shows diagrammatically a bottom wall of a receptacle for casting metal, which is fitted with a casting device according to the invention.

The wall 1 is fitted with an internal spout 2 having a casting channel 3. Under the bottom is situated a fixed plate 4*a* having an orifice 5*a* and a movable plate of a shutter 4b having an orifice 5b which can be brought underneath the channel 3.

According to the invention, a gas supply pipe 6 communicating via a rotary shutter 7 with a storage tank of gas under pressure 8 opens into the orifice 5b. Once it has started to rotate, at a speed which may be controlled, the distributor 7 makes it possible to introduce gas under pressure into the orifice 5b by successive blasts, which produces a succession of shocks of variable amplitude and frequency in order to actuate the plug of metal, which tends to solidify, propelling it inside the receptacle where it becomes liquid once again.

In case of the unplugging of a receptacle, that is to say after the operation of filling, treating and transporting the receptacle, it was usually necessary to fill the casting channel with sand so as to prevent the formation of a plug of solidified steel. However, this method does not always produce a satisfactory result.

Figure 2:
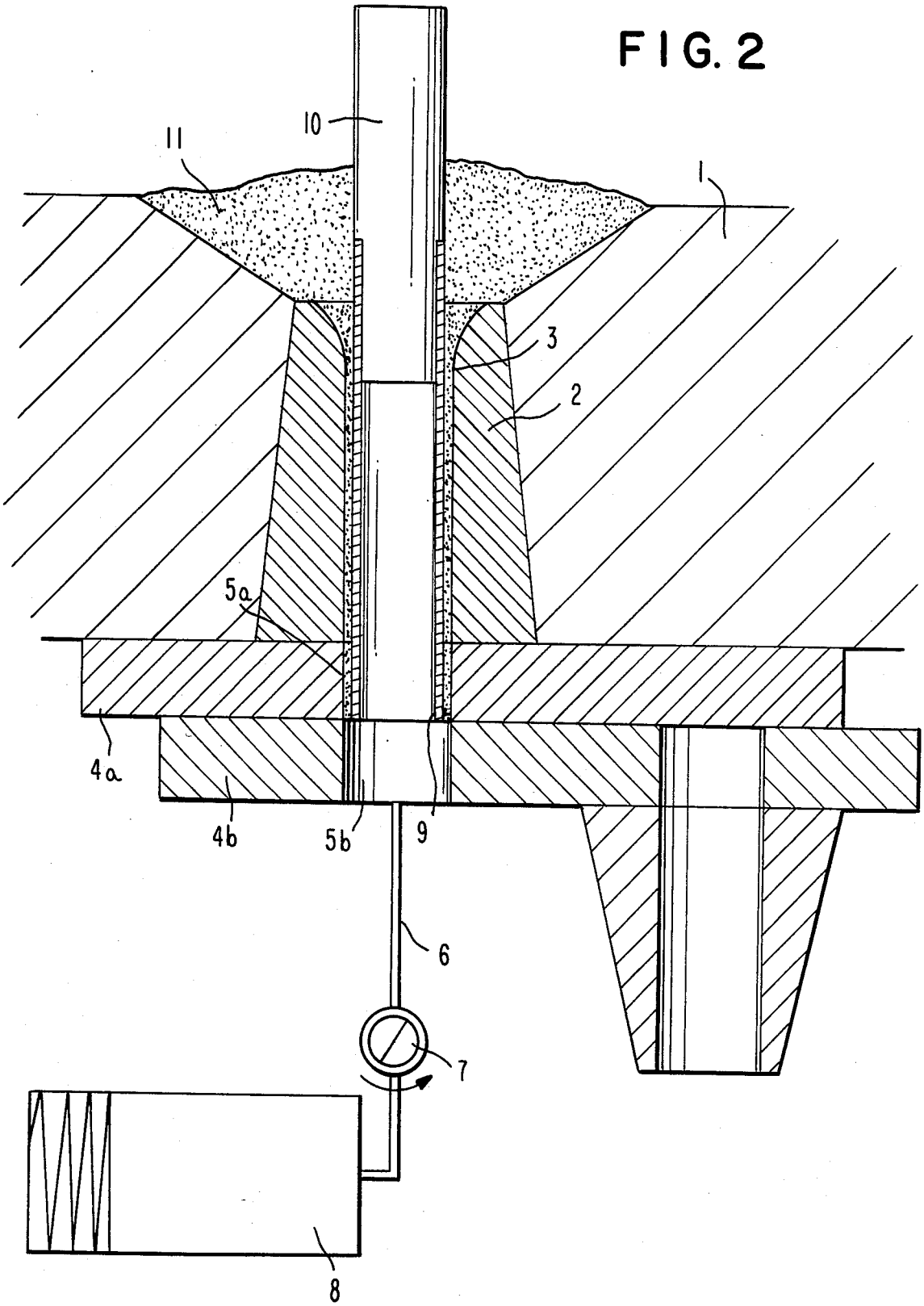
FIG. 2 is a detailed view of the casting hole of a receptacle with a shutter cylinder.

According to an alternative form of the invention (FIG. 2), a rigid cylinder of suitable dimensions, 9, incorporating a sliding cylindrical plunger 10 inside (FIG. 2), is then introduced into the casting channel, before the receptacle is filled. The cylinder may be made of steel or graphite and the plunger—its dimensions and its properties must resist the infiltration of the metal into the cylinder —of graphite.

The cylinder, which projects amply inside the receptacle, is wedged in the vertical position with the aid of sand 11, which also provides the sealing between the cylinder and the wall of the casting channels.

As in the arrangement of FIG. 1, a fluid under pressure delivered by a pipe 6, through the intermediary of a distributor 7, that is employed for unplugging the receptacle by introducing gas under pressure from storage tank 8 in a succession of shocks. As in the arrangement of FIG. 2, the successive shocks or blasts vary in amplitude and frequency. This fluid exerts a lifting force on the base of the plunger and projects it inside the receptacle, thus unplugging the casting channel.

We claim:

1. A method for controlling the flow of molten metal through a casting channel of a receptacle, said casting channel being provided at the bottom of the receptacle and being controlled by an external shutter, said method comprising:

before molten metal is filled into the receptacle, fixing within the casting channel a cylinder containing a slidable plunger that emerges from one end of the cylinder, wherein the plunger projects inside the receptacle;

filling molten metal into the receptacle so that the molten metal contacts the plunger;

applying a pressurized fluid to the plunger to propel the plunger from the cylinder into the receptacle; and removing molten metal from the receptacle through the cylinder and casting channel thus unplugged.

2. Method of claim 1, which comprises wedging the cylinder into the casting channel by packing sand between the cylinder and a wall of the casting channel.

3. Method of claim 1, which comprises applying the pressurized fluid to the plunger as successive blasts of the fluid.

4. Method of claim 3, wherein the blasts of fluid vary in amplitude.

5. Method of claim 3, wherein the blasts of fluid vary in frequency.

6. Method of claim 3, wherein the blasts of fluid vary in amplitude and frequency.

7. Method of claim 1, wherein the cylinder is comprised of graphite.

8. Method of claim 1, wherein the plunger is comprised of graphite.

9. Method of claim 1, wherein the cylinder and the plunger are comprised of graphite.

* * * * *